US006086645A

United States Patent [19]

Quigley et al.

[11] Patent Number: 6,086,645

[45] **Date of Patent: *Jul. 11, 2000**

[54] FUEL ADDITIVES AND COMPOSITIONS

[75] Inventors: Robert Quigley; Gareth Charles Jeffrey, both of Bracknell, United Kingdom

[73] Assignee: Ethyl Petroleum Additives, Ltd, Bracknell, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/857,271

[22] Filed: May 16, 1997

[51] Int. Cl.[7] ..... C10L 1/18; C10L 1/22

[52] U.S. Cl. ..... 44/418

[58] Field of Search ..... 44/418, 419, 393, 44/394

[56] References Cited

U.S. PATENT DOCUMENTS

| | | | |
|---|---|---|---|
| 2,456,569 | 12/1948 | Smith | 44/418 |
| 3,658,493 | 4/1972 | Hollyday, Jr. | 44/394 |
| 4,204,481 | 5/1980 | Malec | 44/418 |
| 4,211,534 | 7/1980 | Feldman | 44/394 |
| 4,481,013 | 11/1984 | Tack et al. | 44/418 |
| 4,661,122 | 4/1987 | Lewtas | 44/418 |
| 5,092,908 | 3/1992 | Feldman et al. | 44/418 |

*Primary Examiner*—Jacqueline V. Howard
*Assistant Examiner*—Cephia D. Toomer
*Attorney, Agent, or Firm*—Dennis H. Rainear; Thomas Hamilton

[57] ABSTRACT

This invention relates to low sulfur fuel compositions which exhibit improved lubricity compared to the low sulfur fuels alone. The low sulfur fuel compositions contain a middle distillate fuel having a sulfur content of 0.2% by weight or less, a carboxylic acid amide and at least one member selected from the group consisting of cold flow improvers, ashless dispersants, and mixtures thereof.

8 Claims, No Drawings

FUEL ADDITIVES AND COMPOSITIONS

The present invention relates to the use of certain additives to improve the lubricating properties of low sulfur-content fuels and to fuels and additive concentrates comprising the compounds.

Sulfur contained in fuel, for example middle distillate fuels such as diesel fuel and jet fuel, is said to constitute a serious environmental hazard. Hence strict regulations have been introduced to limit the amount of sulfur which may be present in such fuels. Unfortunately, fuels having a suitably low sulfur content exhibit very poor inherent lubricity and this can lead to problems when the fuel is used. For example, the use of low sulfur fuel in diesel engines frequently results in damage to the fuel injector pump which relies on the natural lubricating properties of the fuel to prevent component failure. There is therefore a need to improve the lubricating properties of low sulphur fuels. This would enable mechanical failure, for example fuel injector pump failure, caused by inadequate fuel lubricity to be avoided while retaining the environmental benefit of using a low sulfur fuel.

In accordance with the invention, the lubricating properties of low sulfur fuels can be improved by the use of certain additives as described in detail below. Surprisingly, there is a synergistic relationship between the constituents of the additives of the invention.

Accordingly, the present invention provides the use, in order to improve the lubricity of low sulfur-content fuel, of additives comprising:

A) a carboxylic acid amide;

and further comprising

B) a cold flow improver and/or

C) an ashless dispersant.

It has been found that there is a beneficial synergistic effect on fuel lubricity when the additives comprise in combination components A) and B) or components A) and C). The synergistic effect is, however, most pronounced when the additives comprise components A), B) and C) in combination.

The individual components of the additive may be provided in combination as a single additive package. However, as it is the combination of components which is critical other alternatives are, of course, possible. For example, the individual components may be provided separately for incorporation into a fuel, the latter possibly already including one or more of the additive components.

In the present context the term "low sulfur-content fuel" is intended to mean fuels typically having a sulfur content of 0.2% by weight or less, for example 0.05% by weight or less, or 0.005% by weight or less. Examples of fuels in which the additive compounds may be used include low sulfur middle distillate fuels such as diesel and jet fuels and bio-diesel fuel. The latter is derived from a petroleum or vegetable source or mixture thereof and typically contains vegetable oils or their derivatives, such as esters produced by saponification and re-esterification or transesterification. Middle distillate fuels are usually characterised as having a boiling range of 100 to 500° C., more typically from 150 to 400° C.

Component A

Carboxylic acid amides which may be used are commercially available or may be made by the application or adaptation of known techniques.

The carboxylic acid from which the amide A) is derived typically contains up to 60 carbon atoms and may be a mono- or poly-carboxylic acid or a dimerized acid. It may be saturated or unsaturated and may have a branched or straight chain optionally including cyclic moieties. The acid may contain hydroxy-substitution in the acid backbone.

When mono-carboxylic acids are used they typically contain 10 to 40 carbon atoms, more commonly 10 to 30 and especially 12 to 24 carbon atoms. Examples of such include aliphatic fatty acids such as lauric, myristic, heptadecanoic, palmitic, stearic, oleic, linoleic, linolenic, nonadecanoic, arachic or behenic acid. Oleic acid is preferred.

When poly-carboxylic acids are used, such as di- or tri-carboxylic acids, they typically contain 3 to 40 carbon atoms, more commonly 3 to 30 and especially 3 to 24 carbon atoms. Examples of this kind of poly-carboxylic acid include dicarboxylic acids such as succinic, glutaric, adipic, suberic, azelaic and sebacic acids, and tricarboxylic acids such as 1,3,5-cyclohexane tricarboxylic acid and tetracarboxylic acids such as 1,2,3,4-butane tetracarboxylic acid.

Examples of hydroxy-substituted fatty acids which may be used include ricinoleic, malic, tartaric and citric acids.

It is also possible to use optionally hydroxy-substituted "dimerized" acids. Herein such compounds are referred to as "dimer" and "trimer" acids. When used, the "dimerized" acid typically contains 10 to 60, preferably 20 to 60 and most preferably 30 to 60, carbon atoms. Such acids are prepared by "dimerizing" unsaturated acids and typically consist of a mixture of the monomer, dimer and trimer of the acid. An example of a dimerized fatty acid which may be used is the dimerized product of oleic and linoleic acids. Typically this "dimer" exists as a mixture of 2% by weight monomer, 83% by weight dimer and 15% by weight of trimer and possibly higher acids. This "dimerized" acid, as well as the other acids described above, are commercially available or may be prepared by the application or adaption of known techniques.

The amide may be formed by reaction of the carboxylic acid with ammonia or a nitrogen-containing compound of formula (I):

$$R^2[N(R^2)R^1]_qY \qquad (I)$$

in which:

$R^1$ is an alkylene group containing from 2 to 10 carbon atoms;

q is 0 to 10;

Y is optionally N-substituted 1-piperazinyl where the substituent is a group $R^2$ or a group $—[R^1N(R^2)]_qR^2$ in which $R^1$ and q are as defined above, $—N(R^2)_2$ or 4-morpholinyl; and each substituent $R^2$ is independently selected from hydrogen, alkyl having 1 to 6 carbon atoms and a group of formula:

$$—(R^3O)_rR^4$$

in which:

r is 0 to 15;

$R^3$ is an alkylene group having 2 to 6 carbon atoms; and $R^4$ is an hydroxyalkyl group having 2 to 6 carbon atoms, provided that at least one group $R^2$ is hydrogen.

When the compound of formula (I) contains more than one group $R^1$ the groups may be the same or different. The same is true when the compound contains more than one group $R^2$, more than one group $R^3$ and more than one group $R^4$.

The symbol q is preferably 0 to 5. The symbol r is preferably 0 to 10. $R^1$ contains preferably 2 or 3 carbon atoms. When $R^2$ is alkyl the moiety preferably contains from 2 to 4 carbon atoms. $R^3$ is preferably an alkylene group having 2 to 4 carbon atoms. $R^4$ is preferably an hydroxyalkyl group having 2 to 4 carbon atoms. The hydroxyalkyl group preferably contains 1 to 4 hydroxyl groups. When r is greater than zero $R^4$ is preferably a mono-hydroxyalkyl group, for example hydroxyethyl or hydroxypropyl. When r is zero $R^4$ is preferably a mono- or poly-hydroxyalkyl group having up to 4 hydroxyl groups, for example hydroxyethyl, hydroxypropyl or a 1-hydroxy-2,2-bis(hydroxymethyl)ethyl group. The number of carbon atoms in $R^1$ and the value q takes are selected independently. This means for example that when q is greater than zero, $R^1$ may be different in each repeat unit. Similarly, the number of carbon atoms in $R^3$ and the value r takes are independent. This means that, for example, when r is greater than zero, $R^3$ may be the same or different in each ether repeat unit.

According to a preferred embodiment, in the nitrogen-containing compound of formula (I) Y is $—N(R^2)_2$, $R^2$ is ethylene and q is 0 to 3. Examples of such compounds include ethanolamine, diethanolamine, tris(hydroxymethyl) aminomethane, triethylene tetramine or diethylene triamine optionally N-substituted by two hydroxypropyl groups.

In another embodiment, in the nitrogen-containing compound Y of formula (I) is 4-morpholinyl or optionally N-substituted 1-piperazinyl, $R^1$ is an alkylene group containing 2 to 6 carbon atoms, q is 0 or 1 and each $R^2$ is hydrogen. Examples of such compounds include aminoethylpiperazine, bis-(aminoethyl)piperazine and morpholine.

The nitrogen-containing compounds of formula (I) are commercially available or may be made by the application or adaptation of known techniques. For example, the compounds of formula (I) in which r is 1 or more, i.e. those containing an ether or polyether linkage, can be prepared by reaction of a suitable amine, morpholine or piperazine compound with a molar excess of one or more alkylene oxides. When only one kind of alkylene oxide is used $R^3$ and $R^4$ contain the same alkylene moiety. When different kinds of alkylene oxides are used $R^3$ and $R^4$ may contain the same or different alkylene groups.

According to an embodiment of the invention, the amide A) contains at least one free carboxylic group in the acid-derived moiety. This kind of compound may be formed using a polycarboxylic acid as the starting acid, for example a dicarboxylic acid or a dimer or trimer acid. Suitably, the number of moles of reactants is controlled such that the resulting amide contains at least one free carboxylic functional group in the acid derived-moiety. For example, if an acid having two carboxyl functions is used, such as a dicarboxylic or dimer acid, the mole ratio could be about 1:1.

In the case that the amide contains at least one free carboxylic group in the acid-derived moiety, it may be used as is or it may be derivatised further to enhance its properties. The kind of compound used in further derivatising the amide usually depends upon the kind of acid used initially to form the amide and the properties of the amide it is desired to influence. For example, it is possible to increase the fuel-solubility of the amide by introducing into the amide molecule a fuel-solubilizing species. As an example of such, long-chain alkyl or alkenyl groups may be mentioned. To this end the amide may be reacted with an alcohol, ROH or an amine, $RNH_2$, in which R is alkyl or alkenyl having up to 30 carbon atoms, for example 4 to 30 carbon atoms. The number of carbon atoms in the alkyl or alkenyl group may depend upon the number of carbon atoms in the amide itself. These compounds react with the free carboxylic functional group(s) of the amide to form an ester linkage or a further amide linkage. Examples of particular alcohols and amides which may be used include oleyl alcohol and oleyl amine. Dimer and trimer acid amides tend already to contain in the acid backbone long chain alkyl or alkenyl moieties sufficient to provide adequate fuel-solubility.

Alternatively, it is possible by further derivatising the amide to introduce one or more polar head groups. This has the result of increasing the lubricity enhancing effect which the amide exhibits. This is believed to be due to the polar head group increasing the affinity of the amide to metal surfaces. Examples of compounds which may be used to introduce one or more polar head groups include polyamines (e.g. ethylene diamine and diethylene triamine), alkanolamines such as those described above and polyhydric alcohols (e.g. ethylene glycol, diethylene glycol, triethylene glycol, dipropylene glycol, glycerol, arabitol, sorbitol, mannitol, pentaerythritol, sorbitan, 1,2-butanediol, 2,3-hexanediol, 2,4-hexanediol, pinacol and 1,2-cyclohexanediol).

While it has been described above that it is the amide which is derivatised further, it is quite possible that the same final species can be formed by first reacting free carboxyl functional group(s) of a polycarboxylic acid to introduce oil-solubilising or polar head groups and then reacting the resultant product with ammonia or with a nitrogen-containing compound of formula (I) described above to form the amide. Of course, this assumes that the product formed after being derivatised contains at least one free carboxylic group in the acid-derived moiety such that amide formation is still possible.

The further derivatives are commercially available or may be made by the application or adaptation of known techniques.

The preferred amides are oleyl ethanolamide and oleyl diethanolamide.

Component B)

A variety of cold flow improvers may be used in the practice of the invention. As examples of such, mention may be made of cold flow improvers which are ethylene-unsaturated ester copolymers, comb polymers, nitrogen-containing polar compounds, hydrocarbon polymers and linear compounds, and mixtures of any of these. Cold flow improvers which may be used are known in the art and are commercially available from a number of sources. As used herein the term "cold flow improver" also includes pour point depressants, wax crystal modifiers and wax anti-settling additives of the types usually added to middle distillate fuels to improve low temperature properties. Such materials are known in the art and are commercially available.

Examples of ethylene-unsaturated ester copolymers, which may be used as component B) typically include those comprising units of formula $$—CR^5R^6—CHR^7—$$

in which:

$R^5$ is hydrogen or methyl;

$R^6$ is $COOR^8$, in which $R^8$ is an alkyl group having from 1 to 30, for example 1 to 9, carbon atoms, or $R^6$ is $OOCR^9$, in which $R^9$ is $R^8$ or H; and $R^7$ is H or $COOR^8$ as defined above.

This includes copolymers of ethylene with ethylenically unsaturated esters, or derivatives thereof. Thus, the copolymer may be of ethylene with an ester of a saturated alcohol and an unsaturated carboxylic acid or, preferably, the ester of an unsaturated alcohol with a saturated carboxylic acid. The use of ethylene-vinyl ester copolymers is preferred, more particularly ethylene-vinyl acetate, ethylene-vinyl propionate, ethylene-vinyl hexanoate and ethylene-vinyl octancate copolymers. Of these the use of ethylene-vinyl acetate and ethylene-vinyl propionate are particularly preferred.

The copolymer usually contains from 1 to 40 wt %, preferably 5 to 35 wt %, more preferably still from 10 to 35 wt % vinyl ester. Mixtures of two or more copolymers may also be used (see U.S. Pat. No. 3,961,916).

The number average molecular weight of the copolymer, as measured by vapour phase osmometry, is typically 1,000 to 10,000 and preferably 1,000 to 5,000. If desired, the copolymer may contain units derived from additional comonomers, e.g. a terpolymer, tetrapolymer or a higher polymer, for example where the additional comonomer is isobutylene or disobutylene.

The copolymers may be made by direct polymerization of comonomers, by transesterification, or by hydrolysis and re-esterification, of an ethylene unsaturated ester copolymer to give a different ethylene unsaturated ester copolymer.

Comb polymers are polymers in which branches containing hydrocarbyl groups are pendant from a polymer backbone (see "Comb-Like Polymers. Structure and Properties", N. A. Plate et al. Poly. Sci. Macromolecular Revs., 8, pages 117 to 253 (1974)).

The hydrocarbyl groups normally having from 10 to 30 carbon atoms and are bonded directly or indirectly to the polymer backbone. Examples of indirect bonding include bonding via interposed atoms or groups. This can include covalent and/or electrovalent bonding such as in a salt.

The comb polymer is typically a homopolymer or a copolymer having at least 20 and preferably at least 40, and more preferably still at least 50, mole per cent of units having side branches containing at least 6, preferably at least 10, carbon atoms. It is possible for the comb polymer to contain units derived from other monomers.

Examples of comb polymers which may be used include homopolymers of, for example fumaric or itaconic acid, and copolymers of maleic anhydride, fumaric acid or itaconic acid with another ethylenically unsaturated monomer, such as an α-olefin, for example 1-decene, 1-dodecene, 1-tetradecene, 1-hexadecene and 1-octadecene or an unsaturated ester, for example, vinyl acetate. The copolymer may be esterified by reaction with an alcohol such as n-decan-1-ol, n-dodecan-1-ol, n-tetradecan-1-ol, n-hexadecan-1-ol, n-octadecan-1-ol, 1-methylpentadecan-1-ol or 2-methyltridecan-1-ol. Mixtures of alcohols may be used although it is preferred to use pure alcohols rather than the commercially available alcohol mixtures.

Preferred comb polymers are the fumarate and itaconate polymers and copolymers for example as described in EP-A-153176, EP-A-153177, EP-A-225688, WO 91/16407, WO 95/03377 and WO 95/33805.

The preferred fumarate comb polymers are copolymers of ($C_{12-20}$ alkyl) fumarates with vinyl acetate, especially those in which the alkyl groups have 14 carbon atoms or in which the alkyl groups are a mixture of $C_{14}/C_{16}$ alkyl groups. These may be made by known techniques.

Other suitable comb polymers which may be used include the polymers and copolymers of a-olefins and esterified copolymers of styrene and maleic anhydride and esterified copolymers of styrene and fumaric acid.

The comb polymers useful in the invention generally have a number average molecular weight, as measured by vapour phase osmometry, of 1,000 to 100,000, more especially 1,000 to 30,000.

Polar nitrogen compounds which may be used as cold flow improvers are known in the art and usually contain one or more of the same or different nitrogen-bound hydrocarbyl groups, possibly in the form of a cation.

The hydrocarbyl groups generally contain up to 40 carbon atoms. Examples of hydrocarbyl groups include aliphatic (e.g. alkyl or alkenyl), alicyclic (e.g. cycloalkyl or cycloalkenyl), aromatic, and alicyclic-substituted aromatic, and aromatic-substituted aliphatic and alicyclic groups. Aliphatic groups typically contain 12 to 24 carbon atoms and are advantageously saturated.

The hydrocarbyl groups may contain non-hydrocarbon substituents provided their presence does not alter the predominantly hydrocarbon character of the group, such as keto, halo, hydroxy, nitro, cyano, alkoxy and acyl groups. If the hydrocarbyl group is substituted, a single (mono) substituent is preferred. Examples of substituted hydrocarbyl groups include 2-hydroxyethyl, 3-hydroxypropyl, 4-hydroxybutyl, 2-ketopropyl, ethoxyethyl and propoxypropyl.

The hydrocarbyl groups may also or alternatively contain atoms other than carbon in a chain or ring otherwise composed of carbon atoms. Suitable hetero atoms include nitrogen, sulphur, and, preferably, oxygen. The hydrocarbyl group may be bound to one or more nitrogen atoms via an intermediate linking group such as —CO—, —$CO_2$(—), —$SO_3$(—) or hydrocarbylene. When the polar nitrogen compound carries more than one nitrogen-bound substituent, the linking groups for each substituent may be the same or different.

The polar nitrogen compounds may contain amino substituents such as long chain $C_{12}$–$C_{40}$, preferably $C_{12}$–$C_{24}$, alkyl primary, secondary, tertiary or quaternary amino substituents. Preferably, the amino substituent is a dialkylamino substituent which may be in the form of an amine salt thereof (tertiary and quaternary amines can form only amine salts). The alkyl groups may be the same or different.

Examples of primary amino substituents include dodecylamino, tetradecylamino, cocoamino and hydrogenated tallow amino. Examples of secondary amino substituents include dioctadecylamino and methylbehenylamino. Mixtures of amino substituents may be present such as those derived from naturally occurring amines. A preferred amino substituent is the secondary hydrogenated tallow amino substituent, the alkyl groups of which are derived from hydrogenated tallow fat. These are typically composed of approximately 4% $C_{14}$, 31% $C_{16}$ and 59% $C_{18}$ n-alkyl groups by weight.

The polar nitrogen compounds may contain imino substituents such as long chain $C_{12}$–$C_{40}$, preferably $C_{12}$–$C_{24}$, alkyl substituents. The substituents may be monomeric (cyclic or non-cyclic) or polymeric. When non-cyclic, the substituent may be obtained from a cyclic precursor such as an anhydride. The cyclic precursor may include homocyclic, heterocyclic or fused polycyclic assemblies, or a system where two or more identical or different such cyclic assemblies are joined to one another. Where there are two or more such cyclic assemblies, the substituents may be on the same or different assemblies, preferably on the same assembly. Preferably, the or each cyclic assembly is aromatic, more preferably a benzene ring. Most preferably, the cyclic ring system is a single benzene ring when it is then preferred that the substituents are in the ortho- or meta-positions. The benzene ring may be optionally further substituted. The ring atoms in the cyclic assembly or assemblies are preferably carbon atoms but may for example include one or more N, S or O atom.

Examples of polycyclic assemblies include:

(a) condensed benzene structures such as naphthalene, anthracene, phenanthrene and pyrene;

(b) condensed ring structures such as azulene, indene, hydroindene, fluorene and diphenylene oxides;
(c) joined rings such as diphenyl;
(d) heterocyclic compounds such as quinoline, indole, 2,3-dihydroindole, benzofuran, coumarin, isocoumarin, benzothiophen, carbazole and thiodiphenylamine;
(e) partially saturated or non-aromatic ring systems such as decalin (i.e. decahydronaphthalene), α-pinene, cardinene and bornylene; and
(f) three-dimensional structures such as norbornene, bicycloheptane (i.e. norbornane) , bicyclooctane and bicyclooctene.

Further and specific examples of polar nitrogen compounds which may be used in the present invention can be found in the art for example in U.S. Pat. No. 4,211,534, U.S. Pat. No. 4,147,520, U.S. Pat. No. 4,631,071, U.S. Pat. No. 4,639,256, DE-A-3,916,366, EP-A-413,279, EP-A-0,261,957, EP-A-272,889, EP-A-316,108, GB-A-2,121,807, FR-A-2,592,387, DE-A-941,561, EP-A-283,292 and EP-A-353,981.

Hydrocarbon polymer cold flow improvers are known from for example WO 91/11488, WO 95/03377 and WO 95/33805.

The hydrocarbon polymers may be made directly from monoethylenically unsaturated monomers or indirectly by hydrogenating polymers from polyunsaturated monomers, e.g. isoprene and butadiene.

Preferred are ethylene a-olefin copolymers having a number average molecular weight of at least 30,000 as measured by gel permeation chromatography (GPC) relative to polystyrene standards, preferably at least 60,000 and especially at least 80,000. Viscosity mixing difficulties arise when the molecular weight is above about 150,000.

Preferably the α-olefin has at most 30 carbon atoms. Examples of such include propylene, 1-butene, isobutene, n-octene-1, isooctene-1, n-decene-1 and n-dodecene-1. The copolymer may also comprise small amounts, e.g. up to 10% by weight, of other copolymerisable monomers, for example olefins other than α-olefins, and non-conjugated dienes. The preferred copolymer is an ethylene-propylene copolymer.

Usually, the copolymer has a molar ethylene content of between 50 and 85%, preferably 60 to 75%, and most preferably 65 to 70%.

It is also preferred that when used, the ethylene a-olefin copolymers are ethylene-propylene copolymers with a number average molecular weight in the range 60,000 to 120,000, more preferably from 80,000 to 100,000.

The hydrocarbon polymers may be prepared by any of the methods known in the art, for example using a Ziegler type catalyst. The polymers should be substantially amorphous, since highly crystalline polymers are relatively insoluble in fuel oil at low temperatures.

Other suitable hydrocarbon polymers include low molecular weight ethylene-a-olefin copolymers, typically with a number average molecular weight (by GPC) of at most 7500, for example from 1,000 to 6,000, and preferably from 2,000 to 5,000, as measured by vapour phase osmometry. Appropriate α-olefins are as given above. Again, propylene is preferred. Styrene may also be used.

Linear cold flow improver compounds typically comprise a compound in which at least one substantially linear alkyl group having 10 to 30 carbon atoms is linked via an optional linking group to a non-polymeric residue, such as an inorganic residue, to provide at least one linear chain of atoms that includes the carbon atoms of the alkyl groups and one or more non-terminal oxygen, sulphur and/or nitrogen atoms. The linking group may be polymeric. Polyoxyalkylene compounds are frequently used.

By "substantially linear" is meant that the alkyl group is preferably straight chain although alkyl groups having a small degree of branching such as in the form of a single methyl group branch may be used.

The oxygen atom or atoms, if present, are preferably directly interposed between carbon atoms in the chain and may be provided in the linking group, if present, in the form of a mono- or poly-oxyalkylene group, the oxyalkylene group preferably having 2 to 4 carbon atoms. Examples include oxyethylene and oxypropylene.

The linear compound may be an ester, the alkyl groups of which being derived from an acid and the remainder of the compound being derived from a polyhydric alcohol or vice-versa. Alternatively, the linear compound may be an ether or a mixed ester/ether. It may contain different ester groups.

Examples of linear compounds which may be used include polyoxyalkylene esters, ethers, ester/ethers and mixtures thereof, particularly those containing at least one, and preferably at least two, $C_{10-30}$ linear alkyl groups and a polyoxyalkylene glycol group of number average molecular weight (by GPC) up to 5,000, preferably 200 to 5,000 (see EP-A-61895 and in U.S. Pat. No. 4,491,455).

Polyoxyalkylene diesters, diethers, ether/esters and mixtures thereof are also suitable as the cold flow improver B). Here mention may be made to the stearic or behenic diesters of polyethylene glycol, polypropylene glycol or polyethylene/polypropylene glycol mixtures are preferred.

Examples of other linear cold flow improver compounds are described in Japanese Patent Publications Nos. 2-51477 and 3-34790, EP-A-117,108, EP-A-326,356, WO 95/03377 and WO 95/33805. Cyclic esterified ethoxylates are described in EP-A-356,256.

As noted above, mixtures of these cold flow improvers may be use, for example mixtures of ethylene-unsaturated ester copolymers and comb polymers, for example a mixture of an ethylene-vinyl acetate copolymer and a fumarate comb polymer.

Component C)

Ashless dispersants which may be used in the invention as component C) are well-known in the art. Examples include carboxylic ashless dispersants, for example polyamine succinamides and polyamine succinimides, Mannich base dispersants (comprising the reaction product of an alkyl phenol with an aliphatic aldehyde and a polyamine), and polymeric polyamine and hydrocarbyl polyamine dispersants. These kinds of dispersant are described in greater detail in for example EP-A-0531000. The use of polyamine succinimide and Mannich base dispersants is preferred.

Succinimide dispersants may prepared by reacting a substituted succinic acylating agent with an amine/alcohol or an amine alcohol mixture. The succinic acylating agent may be derived from a polyalkene, such as polyisobutene, having a number average molecular weight as measured by GPC of 500 to 8000, for example 900 to 2100, and more particularly 950 to 1300.

Examples of amines which may be used include polyamines containing at least one primary amino group and on average at least two other nitrogen atoms in the molecule. Mention may be made of diethylene triamine, triethylene tetramine, tetraethylene pentamine and pentaethylene hexamine, and mixtures thereof. The reaction ratio of succinic acylating agent to amine is commonly from 1:1 to 2.0:1, preferably between 1.3:1 to 1.8:1, for example about 1.6:1.

The invention further provides a low sulfur fuel comprising component A) and further comprising components B)

and/or C). Such fuel is formulated by simple mixing of the base fuel and the additive constituents in the desired proportions. The base fuel may be a middle distillate fuel or a bio-diesel fuel as described above. Component A is usually present in the fuel in an amount up to 500 ppm, preferably from 15–350, and most preferably from 20–200, ppm. When used, component B is usually present in an amount up to 1000 ppm, preferably from 100 to 500, and most preferably from 200 to 400, ppm. When used, component C is usually present in an amount up to 400 ppm, preferably from 25 to 200, and most preferably from 50 to 150, ppm. These amounts are expressed on a volume for volume basis and thus represent concentrations in microliters per litre of fuel.

For the sake of convenience, the additives of the invention may be provided in the form of a concentrate for dilution with fuel. Such a concentrate forms part of the present invention and typically comprises from 99 to 1% by weight additive and from 1 to 99% by weight of solvent or diluent for the additive which solvent or diluent is miscible and/or capable of dissolving in the fuel in which the concentrate is to be used. The solvent or diluent may, of course, be the low sulfur fuel itself. However, examples of other solvents or diluents include white spirit, kerosene, alcohols (e.g. 2-ethyl hexanol, isopropanol and isodecanol), high boiling point aromatic solvents (e.g. toluene and xylene) and cetane improvers (e.g. 2-ethyl hexylnitrate). Of course, these may be used alone or as mixtures.

The concentrate or fuel may also contain other fuel additives in the appropriate proportions thereby providing a multifunctional fuel additive package. Examples of conventional fuel additives which may be used include fuel stabilisers, detergents, antifoams, cetane number improvers, antioxidants, corrosion inhibitors, antistatic additives, biocides, dyes, smoke reducers, catalyst life enhancers and demulsifiers. The total treat rate for multifunctional formulations containing the lubricity enhancing additives described is typically 25 to 2000 ppm, more usually 60 to 1200 ppm.

The invention also provides a method of reducing fuel pump wear in an engine which operates on a low sulfur-content fuel by using the low sulfur-content fuel described herein. The fuel may be used to reduce wear in rotary and in-line fuel pumps, for example as found in diesel engines, or in fuel transfer pumps. The latter are positioned between the fuel tank and the high pressure fuel pump. The fuel is particularly well suited for reducing wear in fuel injector pumps. The fuel may also be used to reduce wear in the latest fuel injector units which combine fuel pump and injector mechanisms. The invention is particularly well-suited to the operation of diesel and jet engines.

The present invention is illustrated in the following example.

EXAMPLE

The lubricity of a number of diesel fuels was assessed using the High Frequency Reciprocating Rig (HFRR) test conducted in accordance with CEC F-06-T-94. In this test, an electromagnetic drive oscillates a small steel ball against a fixed steel disc. Both disc and ball are immersed in an electrically heated bath containing the test fuel. Wear, and hence the inherent lubricity of the fuel, is assessed by measuring the mean wear scar diameter (MWSD) on the ball, resulting from oscillating contact with the disc. The lower the mean wear scar obtained the greater the lubricity of the fuel. The base fuel used was a Class 2 Scandinavian diesel fuel. This is a diesel fuel having a sulfur content of 0.005% by weight. The composition and distillation profile of this fuel are shown below.

| | |
|---|---|
| Density at 15° C. (IP 160), g/ml | 0.8160 |
| Paraffins, % vol | 89.6 |
| Olefins, % vol | 0.7 |
| Aromatics, % vol | 9.7 |
| Distillation Characteristics (IP 123) | |
| Initial B.P., °C. | 184 |
| 5% | 200 |
| 10% | 204 |
| 20% | 212 |
| 30% | 217 |
| 40% | 223 |
| 50% | 228 |
| 60% | 235 |
| 70% | 243 |
| 80% | 251 |
| 90% | 263 |
| 95% | 269 |
| Final B.P., ° C. | 290 |
| Recovered, % | 99 |
| Residue, % | 1 |
| Loss, % | 0 |

The tables below shows the HFRR test results for a number of diesel fuels.

TABLE 1

| | Component and amount (ppm v/v) | | | HFRR @ 60° C. |
|---|---|---|---|---|
| Run No. | A | B | C | MWSD (μm) |
| 1 | 0 | 0 | 0 | 650 |
| 2 | 25 | 0 | 0 | 680 |
| 3 | 0 | 200 | 0 | 645 |
| 4 | 0 | 0 | 100 | 650 |
| 5 | 0 | 200 | 100 | 630 |
| 6 | 25 | 200 | 0 | 525 |
| 7 | 25 | 0 | 100 | 555 |
| 8 | 25 | 200 | 100 | 415 |

In this table:

Component A is oleyl diethanolamide;

Component B, the cold flow improver, is a commercially available ethylene-vinyl acetate copolymer of a type commonly used in middle distillate fuels having a broad boiling range (20–90 vol% distilling within a band of 100–120° C.), the final boiling temperature being between 360 and 380° C.

Component C, the ashless dispersant, is a polyisobutenyl succinimide derived from polyisobutene having a number average molecular weight of 950. The amine used in preparation of the succinimide was tetraethylene pentamine.

The results obtained clearly demonstrate the improvement in lubricity associated with fuels in accordance with the present invention. The base fuel, run 1, has a very low inherent lubricity resulting in a relatively large mean wear scar diameter in the HFRR test of 650 μm. Similarly poor results are observed in runs 2–5. In runs 2–4 the fuels tested contain only one of components A, B or C. In run 5 the fuel contains components B and C but no component A.

In contrast, runs 6–8, particularly run 8, show a significant improvement in lubricity expressed as a much smaller mean wear scar diameter. It should be noted in runs 6–8 the amounts of components A, B and C are the same as in earlier runs. The fact that much improved lubricity is observed clearly shows that there is a synergistic interaction between the components, i.e. between A and B in run 6, between A and C in run 7 and between A, B and C in run 8. It will be appreciated that this synergistic relationship could enable the amounts of components A, B and/or C to be reduced without significant detriment to the lubricity of the fuel to which the components are added. In turn this could allow savings in materials used.

The synergistic interaction between components A and B was confirmed in a number of other experimental runs as reported in Tables 2 to 6 below.

TABLE 2

| | Component and amount (ppm v/v) | | HFRR @ 60° C. |
|---|---|---|---|
| Run No. | A | B | MWSD (μm) |
| 9 | 0 | 200 | 645 |
| 10 | 25 | 200 | 525 |

Components A and B were the same as in Table 1 above.

TABLE 3

| | Component and amount (ppm v/v) | | HFRR @ 60° C. |
|---|---|---|---|
| Run No. | A | B | MWSD (μm) |
| 11 | 0 | 200 | 670 |
| 12 | 25 | 200 | 360 |

Component A was as above. Component B, the cold flow improver, was a commercially available ethylene-vinyl acetate copolymer of a type commonly used in middle distillate fuels having a broad boiling range (20–90 vol % distilling within a band of 100–120° C.), the final boiling temperature being between 360 and 380° C.

TABLE 4

| | Component and amount (ppm v/v) | | HFRR @ 60° C. |
|---|---|---|---|
| Run No. | A | B | MWSD (μm) |
| 13 | 0 | 200 | 675 |
| 14 | 25 | 200 | 485 |

Component A was as above. Component B, the cold flow improver, was a commercially available modified ethylene-vinyl acetate copolymer of a type commonly used in middle distillate fuels having a narrow boiling range (20–90 vol % distilling within a band of 100° C. or less), the final boiling temperature being about 360° C.

TABLE 5

| | Component and amount (ppm v/v) | | HFRR @ 60° C. |
|---|---|---|---|
| Run No. | A | B | MWSD (μm) |
| 15 | 0 | 200 | 645 |
| 16 | 25 | 200 | 400 |

Component A was oleyl diethanolamide. Component B, the cold flow improver, was a commercially available ethylene-vinyl acetate copolymer of a type commonly used in middle distillate fuels having a broad boiling range (20–90 vol % distilling within a band of 100–120° C.), the final boiling temperature being between 360 and 380° C.

TABLE 6

| | Component and amount (ppm v/v) | | HFRR @ 60° C. |
|---|---|---|---|
| Run No. | A | B | MWSD (μm) |
| 17 | 0 | 200 | 685 |
| 18 | 25 | 200 | 350 |

Component A was as above. Component B, the cold flow improver, was a commercially available ethylene-vinyl acetate copolymer of a type commonly used in middle distillate fuels having a broad boiling range (20–90 vol % within a band of 120° C. or more) and a high final boiling point of at least 390° C.

The cold flow improvers in Tables 1 and 2 were obtained from the same commercial source. The cold flow improvers referred to in Tables 3 and 4 were obtained from a different commercial source as were the cold flow improvers referred to in Tables 5 and 6.

The results in Tables 2–6 confirm the synergy between components A and B.

We claim:

1. A fuel composition comprising (A) a middle distillate fuel having a sulfur content of 0.2% by weight or less, (B) a carboxylic acid amide, and (C) at least one member selected from the group consisting of cold flow improvers, ashless dispersants, and mixtures thereof, wherein the carboxylic acid amide comprises the reaction product of a carboxylic acid selected from the group consisting of oleic acid and linoleic acid, and a diethanolamine.

2. The fuel composition of claim 1 wherein (C) comprises a mixture of at least one cold flow improver and at least one ashless dispersant.

3. The fuel composition of claim 1 wherein the carboxylic acid amide (B) is oleyl diethanolamide.

4. A method of improving the lubricity of low sulfur fuels comprising adding to (A) a middle distillate fuel, having a sulfur content of 0.2% by weight or less, a mixture of (B) a carboxylic acid amide and (C) at least one member selected from the group consisting of cold flow improvers, ashless dispersants, and mixtures thereof, wherein the carboxylic acid amide comprises the reaction product of a carboxylic acid selected from the group consisting of oleic acid and linoleic acid, and a diethanolamine.

5. The fuel composition of claim 1 wherein the carboxylic acid comprises oleic acid.

6. The fuel composition of claim 1 wherein the carboxylic acid comprises linoleic acid.

7. The method according to claim 4 wherein the carboxylic acid comprises oleic acid.

8. The method according to claim 4 wherein the carboxylic acid comprises linoleic acid.

* * * * *